US005195246A

United States Patent [19]

Chansavoir

[11] Patent Number: 5,195,246

[45] Date of Patent: Mar. 23, 1993

[54] METHOD FOR READING THE SHAPE OF ANY ELASTICALLY DEFORMABLE ARTICLE, IN PARTICULAR FOR READING THE CONTOUR OF AN EYEGLASS FRAME RIM OR SURROUND

[75] Inventor: Alain Chansavoir, Luzancy, France

[73] Assignee: Essilor International Cie Generale D'Optique, Creteil Cedex, France

[21] Appl. No.: 936,732

[22] Filed: Aug. 31, 1992

Related U.S. Application Data

[63] Continuation of Ser. No. 839,185, Feb. 21, 1992, abandoned.

[30] Foreign Application Priority Data

Mar. 7, 1991 [FR] France ..... 91 02717

[51] Int. Cl.[5] ..... G01B 7/28

[52] U.S. Cl. ..... 33/28; 33/551

[58] Field of Search ..... 33/28, 200, 507, 546, 33/551

[56] References Cited

U.S. PATENT DOCUMENTS 4,018,010 4/1977 Pozzetti et al. ..... 51/165

4,724,617 2/1988 Logan et al. ..... 33/28

4,995,170 2/1991 Brulé et al. ..... 33/551

FOREIGN PATENT DOCUMENTS 0291378 11/1988 European Pat. Off. .

0386251 9/1990 European Pat. Off. .

2270631 12/1975 France .

0196407 11/1983 Japan ..... 33/507

*Primary Examiner*—Harry N. Haroian

*Attorney, Agent, or Firm*—Young & Thompson

[57] ABSTRACT

A method for reading the shape of any elastically deformable article uses a contact feeler to follow the shape to be read. The contact feeler is applied to the article with a force of particular value adapted to cause localized deformation of the article and the coordinates of the contact feeler are noted at the relevant time. Two successive coordinate readings are systematically carried out, one with a first non-zero set point value of the contact feeler application force and the other with a second non-zero set point value of the application force different than the first set point value. The coordinates for a zero set point value of the contact feeler application force are deduced mathematically from the two coordinate readings.

5 Claims, 1 Drawing Sheet

METHOD FOR READING THE SHAPE OF ANY ELASTICALLY DEFORMABLE ARTICLE, IN PARTICULAR FOR READING THE CONTOUR OF AN EYEGLASS FRAME RIM OR SURROUND

This application is a continuation of application Ser. No. 07/839,185, filed Feb. 21, 1992, now abandoned.

BACKGROUND OF THE INVENTION

1. Field of the invention

The present invention is generally concerned with reading shapes.

It is more particularly directed to the situation in which a contact feeler is used to follow the shape to be read by applying the contact feeler to the article concerned and noting its coordinates at the relevant time.

2. Description of the prior art

This is the case in the published European patent No 291.378 which is more specifically directed to reading the contour of eyeglass frame rims or surrounds.

All contact feeler type contour reading devices currently known have the disadvantage that some force must be used to apply the contact feeler to the article concerned with the result that such application inevitably causes localized deformation of the article when it is a deformable article, as is often the case with eyeglass rims or surrounds, especially if the rims or surrounds are relatively thin and flexible.

The result is inaccurate reading of the contour.

What is more, in the case of reading the contour of eyeglass frame rims or surrounds the means that are necessarily employed to hold the eyeglass frame so that it does not move inevitably cause initial deformation of the rims or surrounds if they brace them laterally, as is usually the case.

This also results in inaccurate reading of the contour.

To avoid these problems shape reading devices have been proposed which use optical or pneumatic means and do not employ any contact feeler.

This is the case, for example, in the published European patent application No 226.349 and also in the German patent application No 38 14 697.

Without it being necessary to go into detail as to their implementation, suffice to say that these shape reading devices are characterized by their non-negligible intrinsic complexity.

They are therefore relatively costly.

Furthermore, there is sometimes doubt as to the focussing of their reading point, to the detriment of the required accuracy.

It is known to control accurately the force with which the contact feeler is applied to the article whose shape is to be read in a contact feeler type contour reading device, as in the European patent No 291.378 mentioned above.

A general object of the present invention is to exploit this possibility and utilize the deformation caused because the deformation in practise usually remains in the elastic range when the application force is relatively weak, as applies in the case of the more usual kinds of eyeglass frame rims or surrounds.

SUMMARY OF THE INVENTION

The present invention consists in a method for reading the shape of any elastically deformable article using a contact feeler adapted to follow the shape to be read wherein said contact feeler is applied to said article with a force of particular value adapted to cause localized deformation of said article and the coordinates of said contact feeler are noted at the relevant time, two successive coordinate readings are systematically carried out, one with a first non-zero set point value of said contact feeler application force and the other with a second non-zero set point value of said application force different than said first set point value, and the coordinates for a zero set point value of said contact feeler application force are deduced mathematically from said two coordinate readings.

In practise because of the elastic nature of the deformation imparted to the article concerned by the contact feeler reading its shape, the calculation required is relatively simple and quick.

If required it can be easily carried out by a computer integrated into the shape reading device.

The effect of the invention is as if the shape reading were carried out with a null force and therefore with no deformation, even though a contact feeler is used to read the shape.

In other words, the invention makes it possible to eliminate totally the effects of the intrinsic deformation actually caused by a contact feeler when reading shapes using a contact feeler.

In the case of reading the contour of an eyeglass frame rim or surround, for example, it is then advantageously possible to hold the eyeglass frame in position using relatively simple and inexpensive holding means, for example holding means which clamp onto the bridge.

Any previous deformation of the rims or surrounds whose contour is to be read is thereby advantageously avoided.

The features and advantages of the invention will emerge from the following description given by way of example with reference to the appended diagrammatic drawings.

DETAILED DESCRIPTION OF THE INVENTION

The figures show by way of example the application of the invention to reading the contour of any rim or surround 10 of any eyeglass frame 11.

In a manner that is known in itself the contour is read using a contact feeler 12 adapted to follow the contour to be read.

The relevant arrangements, which are for example of the same type as those described in the published European patent application No 291.378, are well known in themselves and as they are not relevant to the present invention they will not be described in detail here.

Figure 2:
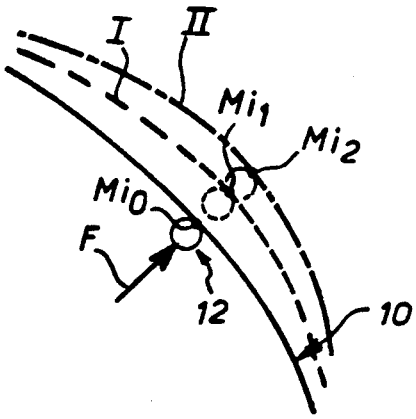
FIG. 2 shows to a larger scale the part of FIG. 1 enclosed in the box II.
Figure 3:
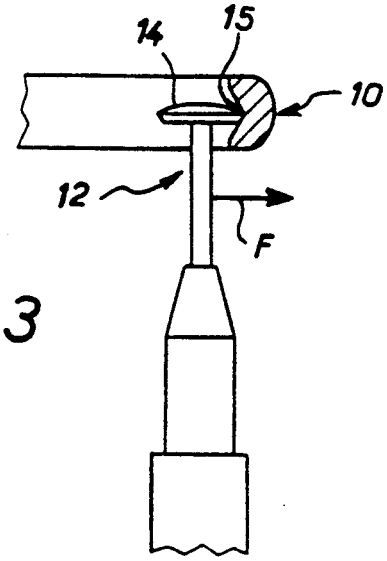
FIG. 3 is a view in cross-section on the line III—III in FIG. 1 to a different scale.

Suffice to say that in practise and as shown by an arrow F in FIGS. 2 and 3 the head 14 of the contact feeler 12 is applied with a particular force F to the back of the bezel 15 of the rim or surround 10 whose contour is to be read and that the coordinates of the contact feeler 12 are noted at the appropriate time, that is to say at the time of such application.

Localized deformation of the rim or surround 10 inevitably occurs as the result of the application of the contact feeler 12 to the rim or surround 10 with the force F.

It is assumed that this localized deformation remains within the limits of elasticity of the rim or surround 10.

In other words, there is no permanent deformation.

According to the invention two consecutive coordinate readings are systematically carried out, one (Xi1Yi1) with a first non-zero set point value F1 of the contact feeler 12 application force F and the other (Xi2Yi2) with a second non-zero set point value F2 of the application force F different than the previous value. The coordinates for a set point value F0 of the contact feeler 12 application force F equal to zero are then deduced mathematically from the two coordinate readings.

Given what has been explained hereinabove, and as diagrammatically illustrated by the respectively dashed and chain-dotted lines I and II in FIG. 2, the rim or surround 10 is deformed locally during each of the two coordinate readings.

Let Mi0 be the original position of any of these points to which the contact feeler 12 is applied, Mi1 the position of this same point during the first coordinate reading and Mi2 its position during the second coordinate reading.

Let Xi0Yi0 be the coordinates of the point Mi0.

By definition these are the required coordinates.

According to the invention they are deduced mathematically from the coordinates Xi1Yi1 of the point Mi1 and Xi2Yi2 of the point Mi2.

Figure 4:
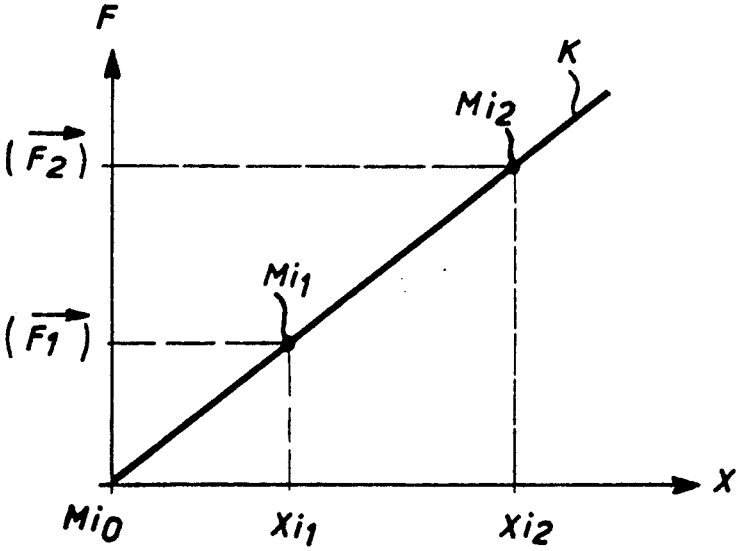
FIG. 4 is a diagram illustrating the calculation required.

Given the assumed elasticity, there exists a direct relationship between the coordinates Xi0Yi0, Xi1Yi1, Xi2Yi2 and the respective set point values F0, F1 and F2 which, as shown by the FIG. 4 diagram relating only to the abscissas Xi0, Xi1, Xi2, can be used to deduce the required coordinates Xi0Yi0 from the two coordinate readings by linear extrapolation.

In practise the slope K of the straight line representing this relationship is proportional to the stiffness of the rim or surround 10 at the point Mi0 in question.

In practise, for the relevant deformations to be elastic deformations it is sufficient for the set point values F1, F2 of the application force F during the two readings to be less than a given value, for example less than 200 gF.

To simplify the operation set point values F1, F2 are preferably chosen which are in an integer ratio to each other.

The set point value F1 is equal to 50 gF and the set point value F2 to 100 gF, for example.

Of course, in the foregoing the set point values F1, F2 are absolute values.

Of course, the invention is not limited to the embodiment described and shown but encompasses any variant execution thereof.

Figure 1:
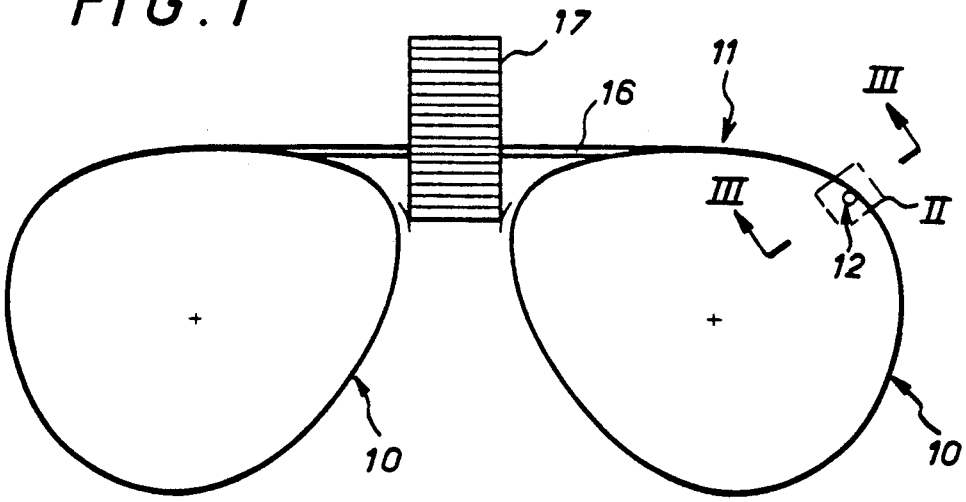
FIG. 1 is a plan view showing the use of a method in accordance with the invention.

In all cases the means employed to hold the eyeglass frame 11 in position may advantageously operate by simple clamping onto the bridge 16 of the frame as shown by the shaded area 17 in FIG. 1.

Finally, it goes without saying that applications of the invention are not limited to reading the contour of a rim or surround of an eyeglass frame but on the contrary encompass more generally any way of reading the shape of any elastically deformable article.

I claim:

1. Method for reading the shape of any elastically deformable article using a contact feeler adapted to follow the shape to be read wherein said contact feeler is applied to said article with a force of particular value adapted to cause localized deformation of said article and the coordinates of said contact feeler are noted at the relevant time, two successive coordinate readings are systematically carried out, one with a first non-zero set point value of said contact feeler application force and the other with a second non-zero set point value of said application force different than said first set point value, and the coordinates for a zero set point value of said contact feeler application force are deduced mathematically from said two coordinate readings.

2. Method according to claim 1 wherein values which are in an integer ratio to each other are chosen for said non-zero set point values of said contact feeler application force.

3. Method according to claim 1 wherein values below 200 gF are chosen for said non-zero set point values of said contact feeler application force.

4. Method according to claim 3 wherein a value of 50 gF is chosen for one non-zero set point value of said contact feeler application force.

5. Method according to claim 3 wherein a value of 100 gF is chosen for one non-zero set point value of said contact feeler application force.

* * * * *